US005749206A

United States Patent [19]

Moore et al.

[11] Patent Number: 5,749,206

[45] Date of Patent: May 12, 1998

[54] STRETCH WRAPPING APPARATUS

[75] Inventors: Phillip Moore, Mount Washington; Patrick R. Lancaster; Robert Denley, both of Louisville, all of Ky.

[73] Assignee: Lantech, Inc., Louisville, Ky.

[21] Appl. No.: 555,824

[22] Filed: Nov. 9, 1995

[51] Int. Cl.[6] ..... B65B 53/00

[52] U.S. Cl. ..... 53/556; 53/588

[58] Field of Search ..... 53/556, 588, 210, 53/399, 441

[56] References Cited

U.S. PATENT DOCUMENTS

| | | | |
|---|---|---|---|
| 3,793,798 | 2/1974 | Lancaster et al. . | |
| 4,232,501 | 11/1980 | Stackhouse . | |
| 4,722,170 | 2/1988 | Ball et al. | 53/556 |
| 5,040,359 | 8/1991 | Thimon | 53/556 |

FOREIGN PATENT DOCUMENTS

| | | | |
|---|---|---|---|
| 3615450 | 11/1987 | Germany | 53/556 |

OTHER PUBLICATIONS

Lantech, Inc. Straddle Lan–Wrapper, Continuing The Lantech Tradition, Undated.

Lantech, Inc., Straddle Lan–Wrapper, 1983.

Lantech, Inc., H–Series™ Straddle Automatic Stretch Wrapping System, 1994.

Lantech, Inc., Selling Guide—V–Series Straddle Automatic System Model SVAST, 1993.

Lantech, Inc., V–Series Straddle Automatic System Model SVAST, 1991.

*Primary Examiner*—Linda Johnson

*Attorney, Agent, or Firm*—Finnegan, Henderson, Farabow, Garrett & Dunner, L.L.P.

[57] ABSTRACT

A stretch wrapping apparatus is provided for stretch wrapping a load with a stretch wrapping material. The apparatus includes a dispenser for dispensing stretch wrapping material and a mechanism for rotating the dispenser around an axis of rotation to wrap the stretch wrapping material around the load. A conveyor transfers the load to and from a wrapping area, the conveyor having two sides and defining a centerline therebetween intersecting the axis of rotation. A frame supports the dispenser including at least one upright leg, only one leg of the frame being disposed on one of the sides of the conveyor and being spaced from a line perpendicularly intersecting the conveyor centerline at the axis of rotation.

13 Claims, 6 Drawing Sheets

STRETCH WRAPPING APPARATUS

BACKGROUND OF THE INVENTION

The present invention relates to a stretch wrapping apparatus, and more particularly to a stretch wrapping apparatus having an improved frame design.

When stretch wrapping loads with a sheet of stretch wrapping material, relative rotation is provided between a material dispenser and a load. This generally is accomplished by either rotating the dispenser around the load, or rotating the load on a turntable adjacent the dispenser. Typically, rotating dispensers rotate around either a vertical axis or a horizontal axis.

In stretch wrapping devices having dispensers that rotate around a vertical axis, the load is moved into a wrapping area, the dispenser is rotated around the load until the load is wrapped, and then the load is moved out of the wrapping area. The dispenser is mounted on a rotatable arm hung from a frame.

The frame of the device may include from one to four upright legs. Where four legs are used, the legs are connected by a bridge, and the rotatable arm is hung from the center of the bridge between the legs. A conveyor transfers the load between two adjacent legs to the wrapping area for wrapping, and then between the other two legs out of the wrapping area.

In two-leg devices, a bridge also extends between the legs to support the rotatable arm. The legs are arranged so that a line connecting them is substantially perpendicular to the direction in which the load travels on the conveyor. In one-leg devices, a cantilevered member extends from the top of the leg to hold the arm. The leg is arranged so that a line connecting the leg and the axis of rotation of the rotatable arm is perpendicular to the direction of load travel on the conveyor.

SUMMARY OF THE INVENTION

It is an object of the invention to provide a low cost stretch wrapping apparatus having a simple and structurally efficient design with a shape and construction that improves access to and around the wrapping area of the apparatus.

In accordance with one aspect of the invention, a stretch wrapping apparatus is provided for stretch wrapping a load with a stretch wrapping material. The apparatus comprises a frame including a first substantially upright leg and a second substantially upright leg spaced from the first leg, the first and second legs defining a frame centerline therebetween. A conveyor extends between the first and second legs for transferring the load to and from a wrapping area, the conveyor defining a conveyor centerline offset from the frame centerline by an angle of less than 90°. A dispenser is rotatably mounted on the frame for dispensing the stretch wrapping material and a mechanism is provided for rotating the dispenser around the load to wrap the stretch wrapping material around the load.

In accordance with another aspect of the invention, a stretch wrapping apparatus is provided for stretch wrapping a load with a stretch wrapping material, the apparatus comprising a dispenser for dispensing the stretch wrapping material and a mechanism for rotating the dispenser around an axis of rotation to wrap the stretch wrapping material around the load. A conveyor transfers the load to and from a wrapping area and defines a centerline that intersects the axis of rotation. A frame supports the dispenser and includes only one upright leg, the leg being spaced from a line perpendicularly intersecting the conveyor centerline at the axis of rotation.

In accordance with yet another aspect of the invention, a stretch wrapping apparatus is provided for stretch wrapping a load with a stretch wrapping material, the apparatus comprising a dispenser for dispensing the stretch wrapping material, and a mechanism for rotating the dispenser around an axis of rotation to wrap the stretch wrapping material around the load. A conveyor transfers the load to and from a wrapping area, the conveyor having two sides and defining a centerline therebetween that intersects the axis of rotation. A frame supports the dispenser and includes only two upright legs, each of the legs being disposed adjacent one of the sides of the conveyor and being spaced from a line perpendicularly intersecting the conveyor centerline at the axis of rotation.

In accordance with another aspect of the invention, a stretch wrapping apparatus is provided having, for example, a frame for supporting the dispenser and including at least one upright leg. Only one leg of the frame is disposed on one of the sides of the conveyor and is spaced from a line perpendicularly intersecting the conveyor centerline at the axis of rotation.

In accordance with still another aspect of the invention, a stretch wrapping apparatus is provided for stretch wrapping a load with a stretch wrapping material, the apparatus comprising a dispenser for dispensing the stretch wrapping material and a mechanism for rotating the dispenser around an axis of rotation to wrap the stretch wrapping material around the load. A frame is provided including a first substantially upright leg, a second substantially upright leg, a third substantially upright leg, and a fourth substantially upright leg. The first and second legs define a first frame centerline therebetween, and the third and fourth legs define a second frame centerline therebetween, the first and second frame centerlines intersecting at the axis of rotation. A conveyor extends between the first and second legs for transferring the load to and from a wrapping area, the conveyor defining a conveyor centerline intersecting the axis of rotation and offset from the each of first and second frame centerlines by an angle of less than 45°.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

It is to be understood that both the foregoing general description and the following detailed description are exemplary and explanatory, only and are not restrictive of the invention as claimed.

BRIEF DESCRIPTION OF THE DRAWINGS

The accompanying drawings which are incorporated in and constitute a part of the specification, illustrate an embodiment of the invention and, together with the description, serve to explain the principles of the invention.

DETAILED DESCRIPTION OF THE PREFERRED EMBODIMENTS

Figure 1:
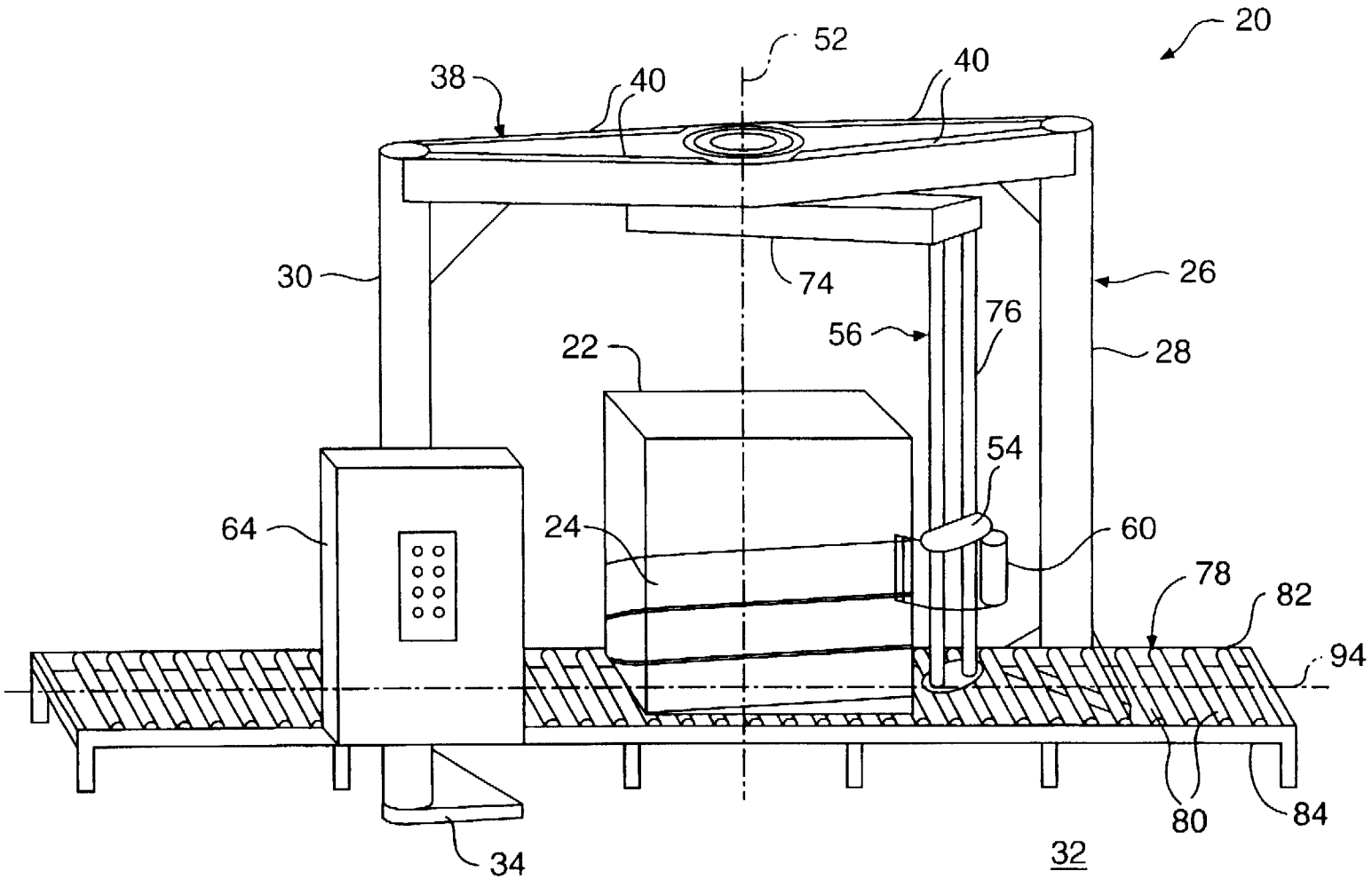
FIG. 1 is a perspective view of a first embodiment of the present invention having two support legs.

Reference will now be made in detail to the present preferred embodiments of the invention, examples of which are illustrated in the accompanying drawings. In some instances, similar reference characters will be used in the drawings to refer to the same or like parts.

Figure 2:
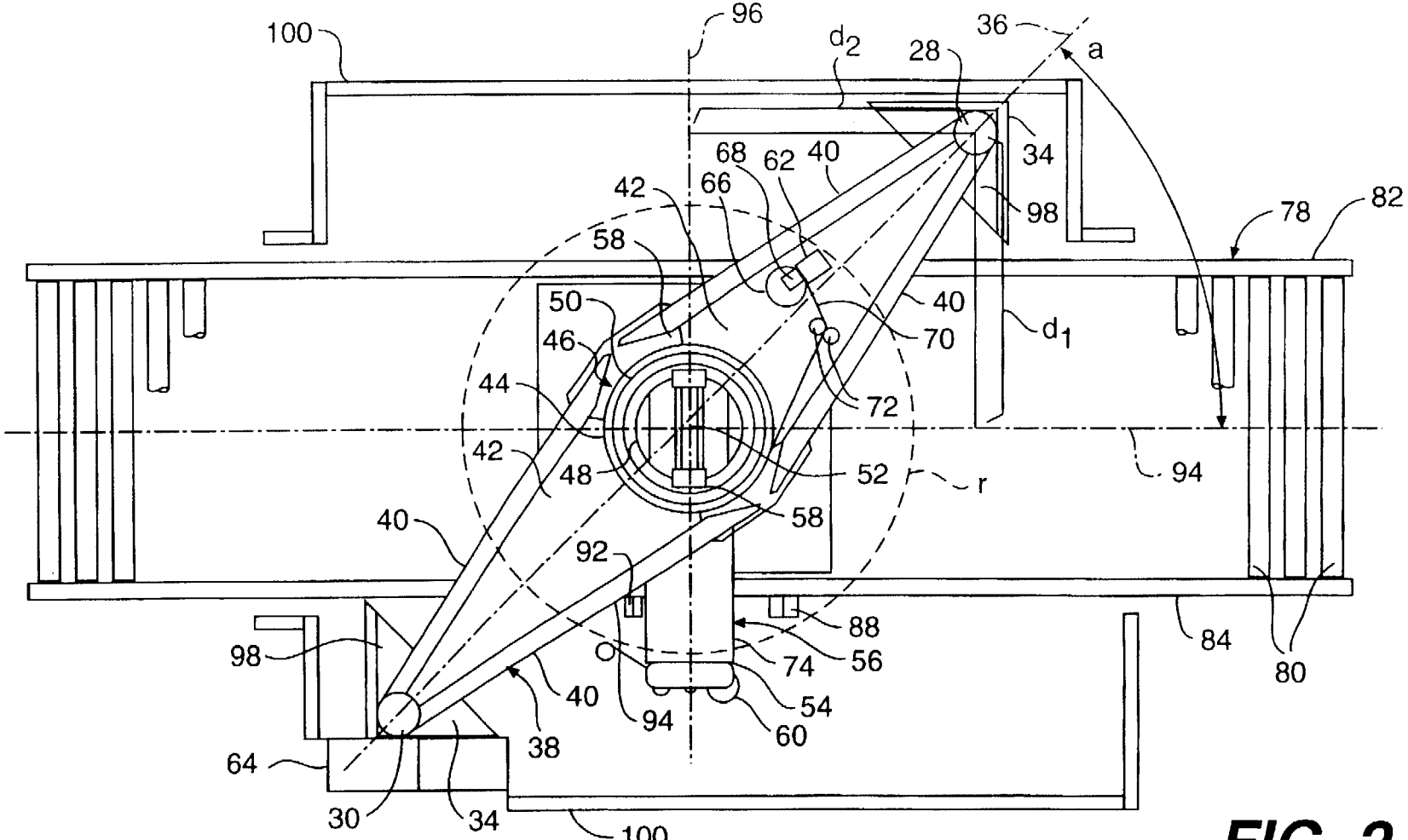
FIG. 2 is a top view of the embodiment of FIG. 1.

According to the present invention, a stretch wrapping apparatus is provided for stretch wrapping a load with a stretch wrapping material. As shown in FIG. 1, a stretch wrapping apparatus 20 stretch wraps a load 22 with stretch wrapping material 24. The apparatus 20 includes a frame 26. In the embodiment of FIGS. 1 and 2, the frame 26 includes a first leg 28 and a second leg 30. Both legs 28, 30 extend upward substantially vertically from a mounting surface 32, which can be a floor or some other structure built upon a floor. As shown in FIGS. 1 and 2, brackets 34 are provided for securing the legs 28, 30 to the mounting surface 32. As shown in FIG. 2, a frame centerline 36 extends between the legs 28, 30. It should be understood that each of the legs 28, 30 can be made of a single column, as shown, or of several clustered columns or similar structure.

The frame 26 includes a bridge 38 that connects the legs 28, 30. Preferably, the bridge 38 is made of four flange members 40 and two plates 42 mounted inside the flange members. The plates 42 include curved edges that form a round hole when assembled. A collar 44 is secured to the plates 42 surrounding the hole, and a bearing member 46 is mounted on the collar. The bearing member 46 includes a first ring 48 fixed to the collar 44 and a second ring 50 rotatable relative to the first ring about a rotational axis 52.

In accordance with the invention, a dispenser is rotatably mounted on the frame for dispensing stretch wrapping material. As shown in FIGS. 1 and 2, a dispenser 54 is mounted on a rotary arm 56 having a first portion 74 secured to the bearing member 46 of the bridge 38, and a second portion 76 holding the dispenser 54. The first portion 74 of the arm 56 is mounted via saddle members 58 on the second ring 50 of the bearing member 46 so as to be rotatable about the vertically extending axis of rotation 52.

The dispenser 54 dispenses stretch wrapping material 24 from a replaceable roll 60. The dispenser 54 may include a prestretch or tensioning device, as are known to those skilled in the art, for stretching or tensioning the stretch wrapping material 24 prior to wrapping it around the load 22. An example of a suitable dispenser is set forth in U.S. Pat. No. 5,161,349, owned by Lantech, Inc. and incorporated by reference herein.

According to the present invention, a mechanism is provided for rotating the dispenser around the load to wrap the stretch wrapping material around the load. As broadly embodied in FIGS. 1 and 2, a motor 62 is provided for driving the rotary arm 56 about the axis of rotation 52. Operation of the motor 62 may be directed by any suitable device, such as a programmable logic controller or a cpu housed within a control box 64. The output of the motor 62 may be coupled to the rotary arm 56 by gears, a chain, a belt, a driven wheel, or any other suitable mechanism. As shown in FIG. 2, the motor 56 drives a drive pulley 66 via gear box 68. The drive pulley 66 drives a drive belt 70 that extends around the second ring 50 of the bearing member 46 and between two nip rollers 72. Frictional contact between the belt 70 and ring 50 rotates the ring and thus the arm 56.

The second portion 76 of the arm 56 extends substantially vertically, and the dispenser 54 can move up and down along the second portion during wrapping, as directed by the control box 64. The first portion 74 of the arm 56 can have several alternate attachment points at which the arm can be attached to the saddle members 58, thereby providing wrap paths having different radii. Wrap path r is shown in dotted lines in FIG. 2.

According to the invention, a conveyor extends between the first and second legs for transferring the load to and from a wrapping area. As shown in FIGS. 1 and 2, a conveyor 78 includes a plurality of rollers 80 mounted between opposite sides 84, 88 that extend between the first and second legs 28, 30. The conveyor 78 moves the load 22 to and from the wrapping area, which is inside of wrap path r.

As shown in FIG. 2, various commonly used stretch wrapping elements may be mounted on the conveyor 78. For example, a clamp 88 may be provided for gripping an end of the stretch wrapping material 24 during initiation and termination of a wrapping cycles. The clamp 88 may be a vacuum clamp, in which the stretch wrapping material is held by vacuum, or a gripping clamp, in which the stretch wrapping material is held between opposable members. A cutter 90 may also be provided for cutting the stretch wrapping material at the end of a wrapping cycle. The cutter 90 may include a cutting blade or blades, or a heating element, as are commonly used. If desired, the cutter 90 may be formed unitary with the clamp 88. A wipedown device 92 may be provided for attaching a cut end of stretch wrapping material to the load after being cut by the cutter 90.

In accordance with the invention, the conveyor defines a conveyor centerline offset from the frame centerline by an angle of less than 90°. As embodied in FIGS. 1 and 2, the conveyor 78 moves the load 22 along a centerline 94 running the length of the conveyor in the conveying direction and through the axis of rotation 52 of the arm 56. The conveyor centerline 94 intersects the frame centerline 36 at an angle a which is less than 90°. The legs 28, 30 are located closer to the sides 82, 84 of the conveyor 78, and the legs are moved to the side of the wrapping area, by making angle a less than 90°, rather than equal to 90°. Arranging the legs 28, 30 and conveyor 78 so that the angle of intersection a between the centerlines 36, 94 is less than 90° thus allows for an arrangement having the benefits of using less space and providing better access to the wrapping area than if the angle a were equal to 90°.

Preferably, at least one of the legs is disposed closer to the conveyor centerline than to a line perpendicularly intersecting the centerline at the axis of rotation. As shown in FIG. 2, leg 28 is disposed a distance $d_1$ from the conveyor centerline 94. Leg 28 is also disposed a distance $d_2$ from a line 96 extending perpendicularly from the conveyor centerline 94, with $d_2$ being larger than $d_1$. This preferred relationship between $d_1$ and $d_2$ ensures that the angle a between the centerlines is less than 45°. Minimizing the distance $d_1$ for a given frame size allows the device 20 to take up less floor space in the direction perpendicular to the conveyor centerline 94. Saving lateral space can be especially useful in applications where a number of stretch wrapping devices 20 are used side by side.

Figure 3:
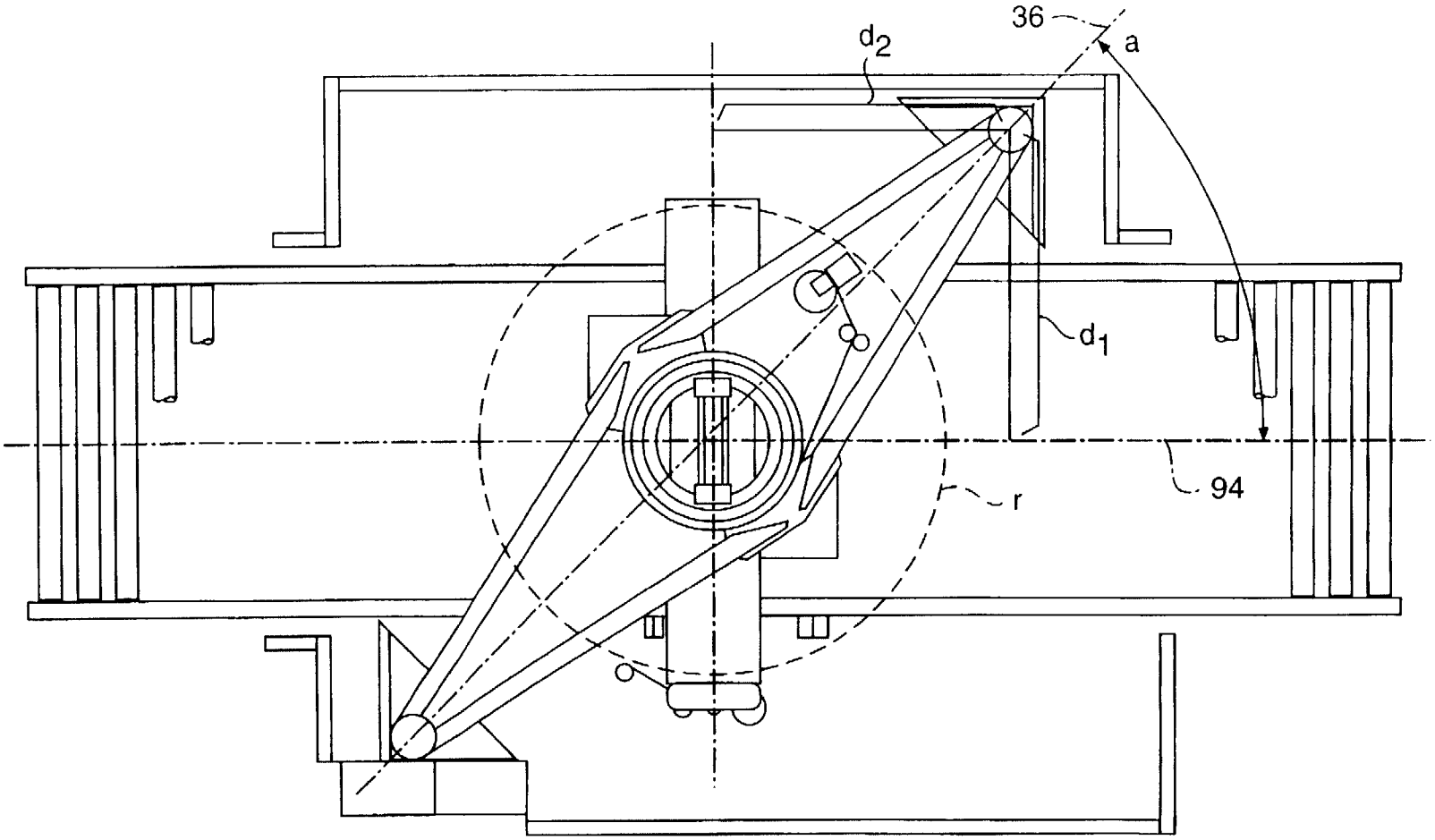
FIG. 3 is a top view of embodiment of FIG. 1 with support legs in a different location.

Thus, preferably, the angle between the conveyor centerline and the frame centerline is less than about 45°. More preferably the angle is about 35°. As shown in FIG. 3, the angle a between the conveyor centerline 94 and the frame centerline 36 is about 35° (as compared to the FIG. 2 angle a which is just less than 45°). The 45° and 35° degree angles are preferred because, using these angles, conventional standard sized loads (described below) can be wrapped using the device, while the lateral size of the device can be substantially reduced without requiring the bridge portion of the frame to be made so long that its expense becomes prohibitive or the stability of the frame is compromised. In some applications, 45° and 35° angles can be achieved simply by properly orienting the legs without lengthening the bridge. The lower limit of this angle of intersection may be controlled by the width of the conveyor and length of the bridge.

The angle a can be reduced from 90° to 45°, or to 35° or less, by modifying the structure of the apparatus 20 in several ways. First, if the distance between the legs is maintained, one or both of the legs can be moved closer to the conveyor to the point that the legs are proximate the conveyor sides. Second, if the distance between the legs and the conveyor is not changed, the legs can be spaced further apart, making the bridge longer. Third, both of the above methods can be used. That is, the leg separation can be increased and the legs can be moved closer to the conveyor. While lengthening the distance between the legs without changing the distance between the legs and the conveyor will not result in a device with a smaller lateral size than the un-lengthened device, the lateral size is smaller than that of a lengthened device in which the leg to conveyor distance was not held constant. Thus, all three of the above design alterations result in devices having smaller lateral sizes than similar devices not utilizing the above alterations.

Of course, the spacing of the legs relative to the conveyor sides and the angle between centerlines is dependent to some extent on the width of the conveyor and horizontal size of the rotary arm. Both of these dimensions are usually functions of the size of the load to be wrapped. For example, three standard load areas are 40"×48", 48"×48", and 60"×60". The conveyor is typically several inches wider than the load. The rotary arm is usually sized so that the dispenser travels in a wrapping path having a radius several inches larger than the distance to the corner of the load furthest from the axis of rotation. For the above three loads, the rotary arm would be designed to provide a wrap radius of about 70", 80", and 90", respectively.

Thus, the conveyor width is chosen so as to accommodate the loads to be wrapped. The size of the rotary arm needed to wrap the loads is then determined. The minimum bridge size needed to allow the rotary arm to clear the legs and for the legs to be placed in the positions described above relative to the centerlines, $d_1$, $d_2$, and angle a is then determined. The legs are then placed in the desired locations.

For some special wrap applications, the load width may be even smaller than those described above. For these applications, the angle a may be as small as only 20° to 30°, with the minimum possible value of angle a being dependent on load and conveyor widths.

Optionally, at least one of the legs is secured to the conveyor. As shown in FIGS. 1 and 2, the legs 28, 30 are secured to the conveyor 78 by bars 98, thereby improving the stability of the apparatus 20. Alternately, the legs 28, 30 or the brackets 34 attached to the bottoms of the legs 28, 30 can be secured directly to the conveyor 78.

Preferably, safety barriers are provided to prevent access to the wrapping area while the rotary arm is moving. As shown in FIG. 2, a barrier 100 made of a number of wall members is provided about the apparatus 20. The arrangement of the barrier 100 is determined by the location and size of the legs 28, 30 and conveyor 78.

Figure 4:
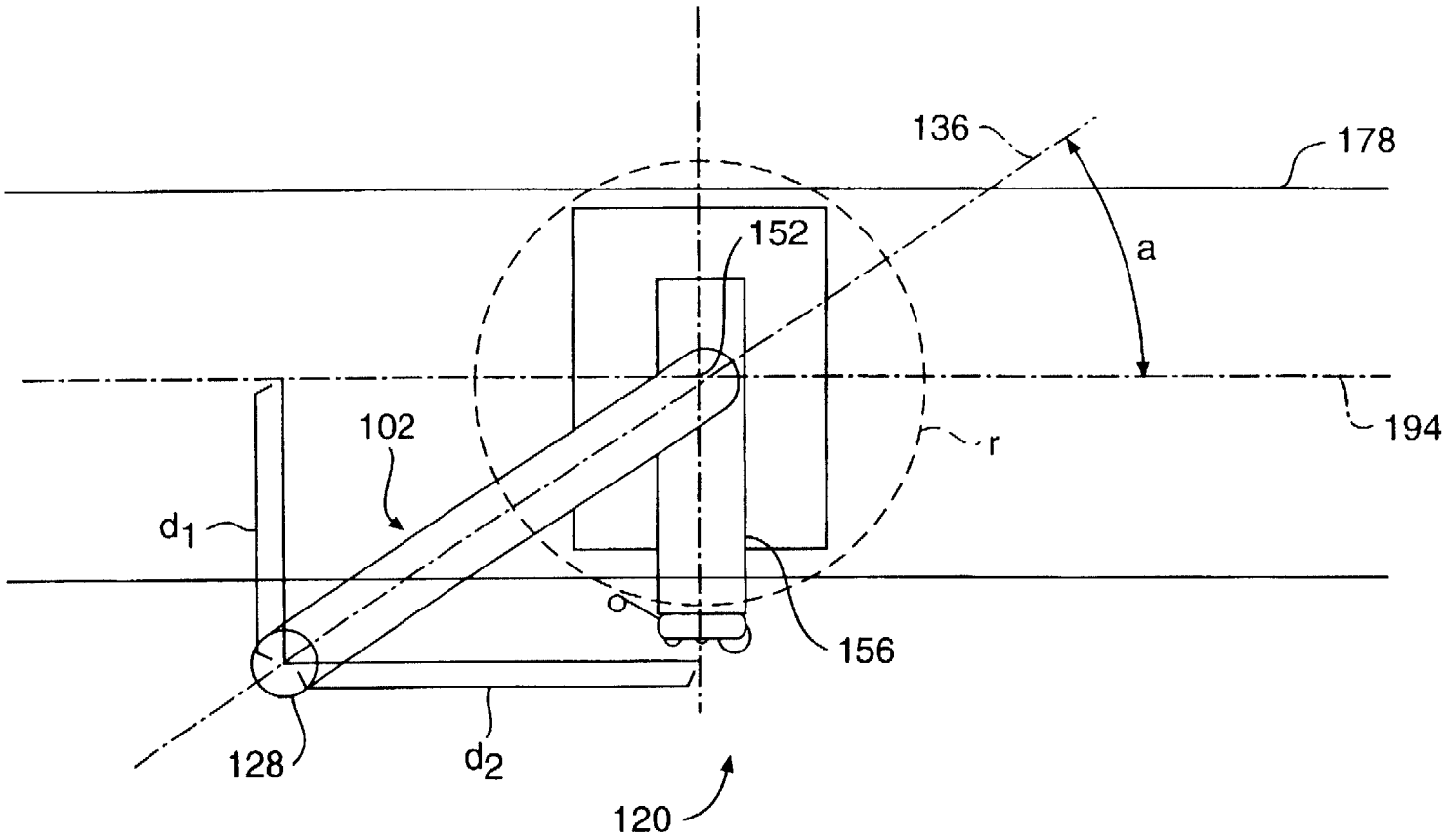
FIG. 4 is a diagrammatical top view of an alternate embodiment of the present invention having one support leg.

An alternate embodiment of the invention is diagrammatically shown in FIG. 4. In this embodiment, an apparatus 120 is provided having a single leg 128 adjacent a conveyor 178. The leg 128 supports a cantilevered member 102 on which a rotary arm 152 is mounted. A frame centerline 136 extends from the leg 128 through an axis of rotation 152 and intersects a conveyor centerline 194 at an angle a, which is less than 90°, preferably less than 45°, and more preferably about 35°. The leg 128 is preferably located adjacent the conveyor 178 so that $d_2$ is greater than $d_1$. Placement of the leg 128 in the position shown in FIG. 4 provides a smaller lateral size than if the leg had been placed so that the frame centerline 136 extended perpendicular to the conveyor centerline 194.

Figure 5:
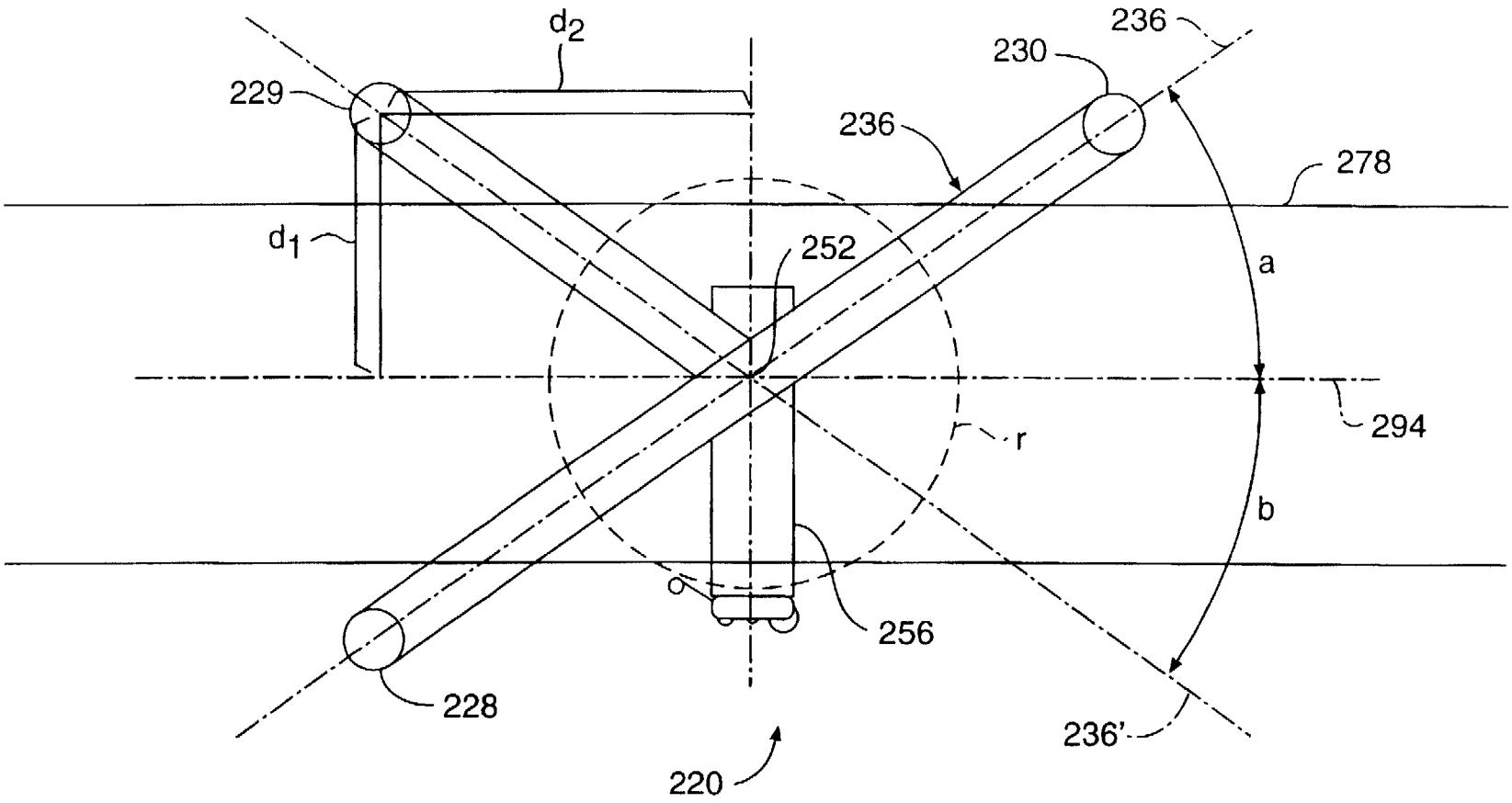
FIG. 5 is a diagrammatical top view of another alternate embodiment of the present invention having three support legs.

FIG. 5 shows another alternate embodiment of the present invention. In the embodiment of FIG. 5, a wrapping apparatus 220 has three legs 228, 229, 230 joined by a bridge 238. Two of the legs 228, 230 are placed at locations similar to the legs shown in FIGS. 1–3. The third leg 229 is located adjacent the conveyor 278 so that the three legs are located at the corners of a right triangle, with the frame centerline 236 that extends between legs 228 and 230 being the hypotenuse of the triangle. A second frame centerline 236' extending between the third leg 229 and the axis of rotation 252 intersects the conveyor centerline 294 at an angle b, preferably less than 45°, more preferably about 35°, and also preferably equal to angle a between centerlines 236 and 294. As shown, $d_2$ for this embodiment is preferably less than $d_1$, just as for the previous embodiments. This arrangement of legs 228, 229, and 230 provides a smaller lateral size than if the frame centerlines 236 and 236' intersected perpendicularly.

Figure 6:
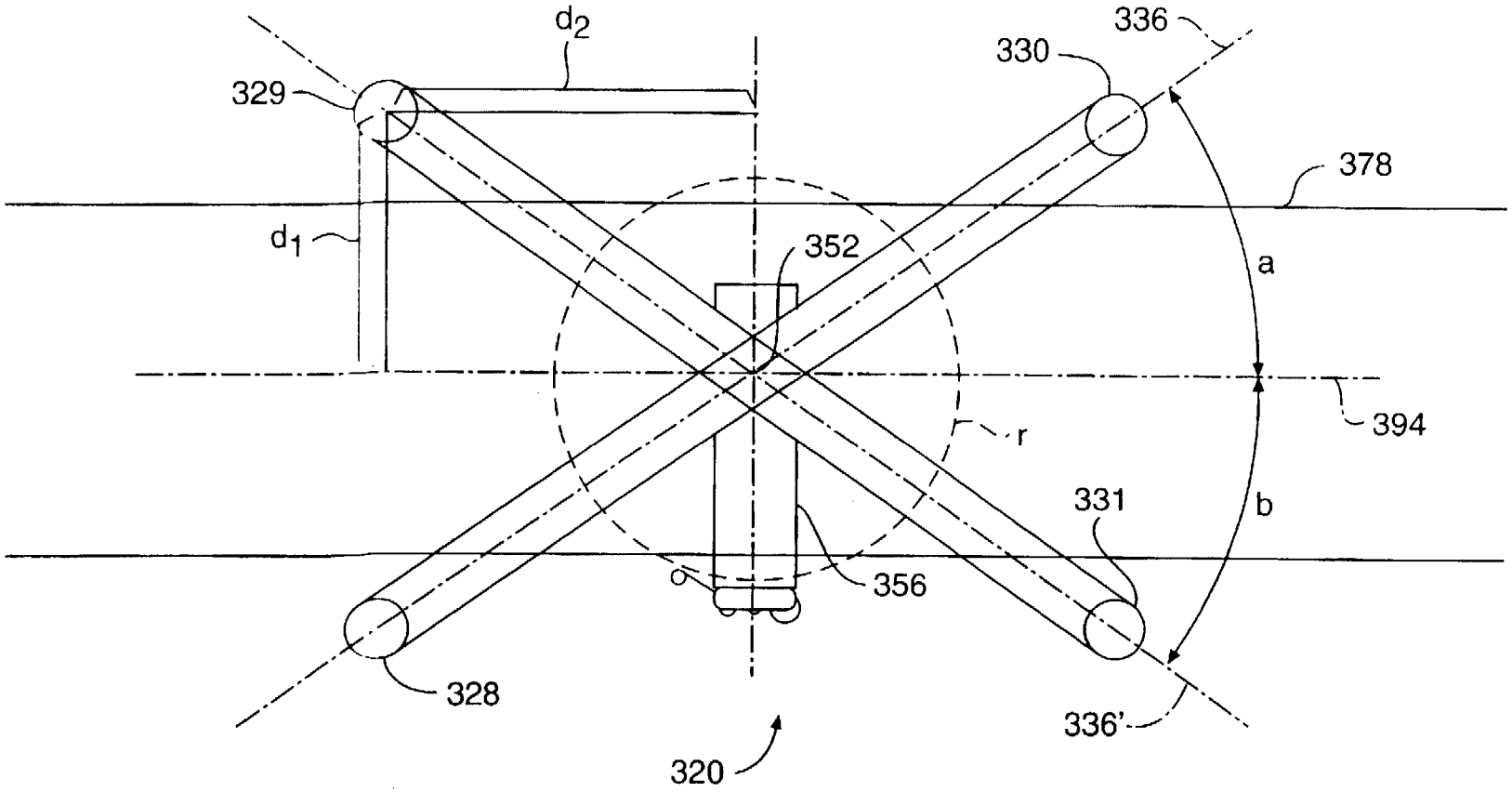
FIG. 6 is a diagrammatical top view of yet another alternate embodiment of the present invention having four support legs.

Another embodiment of the present invention is shown in FIG. 6. In this embodiment, an apparatus 320 has four legs 328, 329, 330, 331 that are joined by a bridge 338. Three of the legs 328, 329, and 330 are spaced in the same locations as the legs of the device of FIG. 5. The fourth leg 331 is located at a symmetrical location, relative to the frame centerline 336, as leg 329. Angles a and b, and lengths $d_1$ and $d_2$ are of similar proportion and ratio in this embodiment as for the previous embodiment.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims and their equivalents.

What is claimed is:

1. A stretch wrapping apparatus for stretch wrapping a load with a stretch wrapping material, the apparatus comprising:

a dispenser frame including a first substantially upright leg and a second substantially upright leg spaced from the first leg, the first and second legs defining a frame centerline therebetween;

a conveyor extending between the first and second legs for transferring the load to and from a wrapping area, the conveyor having a conveyor centerline wherein a line perpendicular to the conveyor centerline divides the wrapping area into four quadrants, the first and second legs being located in diagonally opposed first and second quadrants on opposite sides of the conveyor, and wherein at least one of the remaining third and fourth quadrants does not contain a leg of the dispenser frame;

a dispenser rotatably mounted on the dispenser frame for dispensing the stretch wrapping material; and means for rotating the dispenser around the load to wrap the stretch wrapping material around the load.

2. The apparatus of claim 1, wherein at least one of the first or second legs is directly secured to the conveyor.

3. The apparatus of claim 1, wherein the first and second legs are directly secured to the conveyor.

4. The apparatus of claim 1, wherein a frame centerline defined between the first and second legs crosses the conveyor centerline to form an angle of less than about 45°.

5. The apparatus of claim 1, wherein a frame centerline defined between the first and second leas crosses the conveyor centerline to form an angle of less than about 35°.

6. The apparatus of claim 1, wherein the frame further includes a third substantially upright leg located in either the third or fourth quadrant, the first, second and third legs being disposed at the corners of a right triangle having a frame centerline defined between the first and second legs as the hypotenuse, the angle between the conveyor centerline and the frame centerline being less than 45°.

7. The apparatus of claim 6, wherein the angle between the conveyor centerline and the frame centerline is about 35°.

8. The apparatus of claim 6, wherein the first, second, and third legs are secured to the conveyor.

9. A stretch wrapping apparatus for stretch wrapping a load with a stretch wrapping material, the apparatus comprising:

a dispenser for dispensing the stretch wrapping material;

means for rotating the dispenser around an axis of rotation to wrap the stretch wrapping material around the load;

a conveyor for transferring the load to and from a wrapping area, the conveyor having two sides and defining a centerline therebetween that intersects the axis of rotation; and a frame for supporting the dispenser, the frame having only two upright legs, each of the legs being disposed adjacent one of the sides of the conveyor and being spaced from a line perpendicularly intersecting the conveyor centerline at the axis of rotation and positioned diagonally across the conveyor.

10. The apparatus according to claim 1, wherein the frame includes a bridge connecting the first and second legs along a frame centerline defined between the first and second legs.

11. The apparatus according to claim 9, wherein the frame includes a bridge connecting the first and second legs along a frame centerline defined between the first and second legs.

12. The apparatus according to claim 1, wherein the legs of the frame and the axis of rotation are aligned with each other.

13. The apparatus according to claim 9, wherein the legs of the frame and the axis of rotation are aligned with each other.

* * * * *

UNITED STATES PATENT AND TRADEMARK OFFICE

CERTIFICATE OF CORRECTION

PATENT NO. : 5,749,206
DATED : May 12, 1998
INVENTORS : Phillip MOORE, et al.

It is certified that error appears in the above-identified patent and that said Letters Patent is hereby corrected as shown below:

Claim 5, column 7, line 17, "leas" should read --legs--.

Signed and Sealed this

Twenty-first Day of July, 1998

Bruce Lehman

*Attest:*

BRUCE LEHMAN

*Attesting Officer*

*Commissioner of Patents and Trademarks*